US006550261B1

(12) United States Patent
Shima et al.

(10) Patent No.: US 6,550,261 B1
(45) Date of Patent: Apr. 22, 2003

(54) LOW TEMPERATURE STORAGE CABINET

(75) Inventors: Tsuyoshi Shima, Shimane-ken (JP); Tomio Suyama, Shimane-ken (JP); Toshiaki Hara, Shimane-ken (JP)

(73) Assignee: Hoshizakidenki Kabushiki Kaisha, Toyoake (JP)

( * ) Notice: Subject to any disclaimer, the term of this patent is extended or adjusted under 35 U.S.C. 154(b) by 0 days.

(21) Appl. No.: 09/995,783

(22) Filed: Nov. 29, 2001

(51) Int. Cl.[7] ..... F25B 49/00

(52) U.S. Cl. ..... 62/176.1; 62/176.6; 62/440; 219/385

(58) Field of Search ..... 62/176.1, 176.6, 62/248, 275, 440; 219/385; 312/236

(56) References Cited

U.S. PATENT DOCUMENTS 4,127,765 A * 11/1978 Heaney ..... 62/248
5,271,236 A * 12/1993 Sweetser ..... 62/176.6
5,778,147 A * 7/1998 Kim ..... 62/176.6
5,842,597 A * 12/1998 Kraus et al. ..... 62/176.1
5,845,508 A * 12/1998 Takeda ..... 62/127
6,014,865 A * 1/2000 Kim et al. ..... 62/131
6,058,722 A * 5/2000 Choi ..... 62/131
6,104,003 A * 8/2000 Jones ..... 165/104.33
6,223,543 B1 * 5/2001 Sandelman ..... 62/176.6

FOREIGN PATENT DOCUMENTS

JP 410339555 A * 12/1998 ..... F25D/21/04

* cited by examiner

*Primary Examiner*—William E. Tapolcai
*Assistant Examiner*—Mohammad M. Ali
(74) *Attorney, Agent, or Firm*—Nixon & Vanderhye P.C.

(57) ABSTRACT

A low temperature storage cabinet wherein a heater is embedded in an opening frame structure of the cabinet to prevent the occurrence of dewfall on a surface of the frame structure to be brought into contact with a door hinged to the cabinet body, and wherein operation of a compressor is controlled in accordance with an inside temperature of the cabinet to maintain the inside temperature of the cabinet at a predetermined value. In the storage cabinet, the heater is activated synchronously in response to operation of the compressor and is activated in accordance with outside humidity or inside temperature of the cabinet during stopping of the compressor.

6 Claims, 7 Drawing Sheets

LOW TEMPERATURE STORAGE CABINET

BACKGROUND OF THE INVENTION

1. Field of the Invention

The present invention relates to a low temperature storage cabinet such as a refrigerator cabinet, a freezer cabinet, a refrigerator/freezer cabinet or the like for storing an article such as foodstuffs, beverages, etc.

2. Description of the Prior Art

There has been proposed a low temperature storage cabinet wherein a heater is embedded in an opening frame structure of the cabinet to prevent the occurrence of dewfall on the surface of the frame structure to be brought into contact with a door hinged to the cabinet body and wherein operation of a compressor is controlled in accordance with an inside temperature of the cabinet to maintain the inside temperature of the cabinet at a predetermined value.

As in the low temperature storage cabinet, the heater for prevention of dewfall in the cabinet is activated during operation of the compressor, the load for cooling the interior of the cabinet is increased due to heat generation of the heater. This causes frequent operation of the compressor, resulting in useless consumption of the electric power.

To solve the problem, proposed in Japanese Patent Laid-open Publications Nos. 6 (1994)-3034, 6 (1994)-3035, 5 (1993)-142845, 5 (1993)-240565 and Japanese Utility Model Laid-open Publications 62 (1987)-16623, 62 (19987)-88277 are various control methods of the heater in relation to operation of the compressor, an outside temperature of the cabinet, a temperature of dewfall or outside humidity of the cabinet. However, in this type of the low temperature storage cabinet, it is required to further decrease the consumption of the electric power caused by activation of the heater for prevention of dewfall in the cabinet.

SUMMARY OF THE INVENTION

It is, therefore, a primary object of the present invention to provide a low temperature storage cabinet capable of further decreasing the unnecessary consumption of electric power caused by unneeded activation of the heater.

According to the present invention, the object is accomplished by providing a low temperature storage cabinet which includes a heater embedded in an opening frame structure of the cabinet to prevent the occurrence of dewfall on a surface of the frame structure to be brought into contact with a door hinged to the cabinet body, and a compressor the operation of which is controlled in accordance with an inside temperature of the cabinet to maintain the inside temperature of the cabinet at a predetermined value, wherein the heater is activated synchronously in response to operation of the compressor and is activated in accordance with outside humidity or inside temperature of the cabinet during stopping of the compressor.

In a practical embodiment, the low temperature storage cabinet is provided with an inside temperature sensor for detecting an inside temperature of the cabinet, a humidity sensor for detecting outside humidity of the cabinet, and control means responsive to a detection signal from the inside temperature sensor or humidity sensor for controlling activation of the heater in accordance with the inside temperature or outside humidity of the cabinet.

In another practical embodiment of the present invention, the low temperature storage cabinet is provided with an outside temperature sensor for detecting an outside temperature of the cabinet, a humidity sensor for detecting outside humidity of the cabinet, and control means for calculating a dewfall temperature on the surface of the opening frame structure based on the outside temperature and outside humidity detected by the sensors and for controlling activation of the heater in accordance with the calculated dewfall temperature.

In a further practical embodiment of the present invention, the low temperature storage cabinet is provided with a surface temperature sensor for detecting a surface temperature of the opening frame structure, wherein the control means is responsive to a detection signal from the surface temperature sensor to activate the heater when the surface temperature of the frame structure is equal to or lower than the calculated dewfall temperature and to deactivate the heater when the surface temperature of the frame structure is higher than the calculated dewfall temperature.

BRIEF DESCRIPTION OF THE DRAWINGS

Other objects, features and advantages of the present invention will be more readily appreciated from the following detailed description of preferred embodiments thereof when taken together with the accompanying drawings, in which:

FIG. 5(*b*) is a time chart showing a control condition of activation of the heater for prevention of dewfall in the storage cabinet under a conventional manner;

FIG. 10(*b*) is a third control circuit for adjusting an activation rate of the heater.

DESCRIPTION OF THE PREFERRED EMBODIMENT

Figure 1:
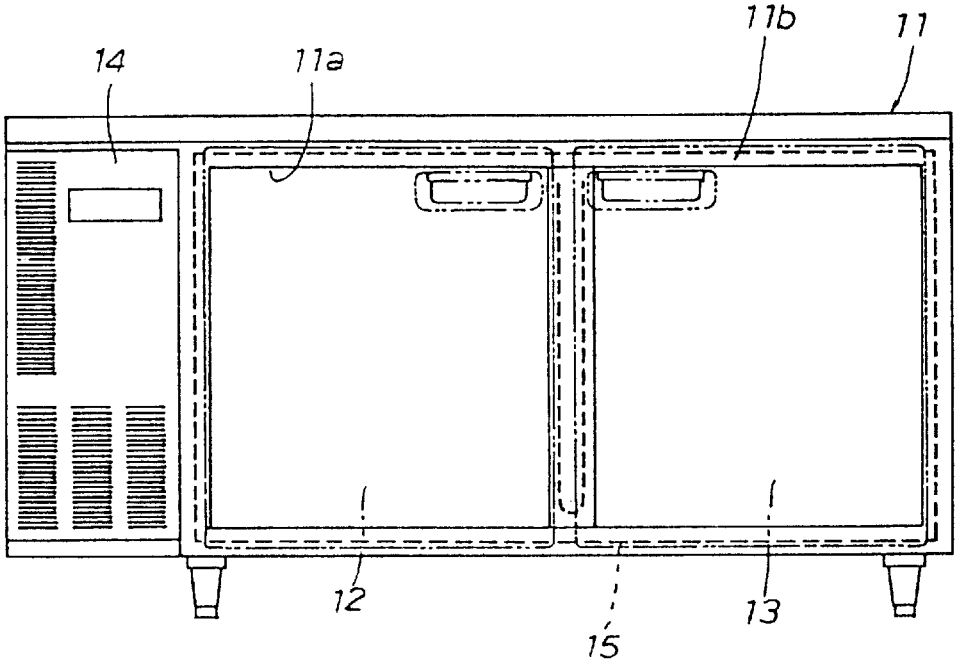
FIG. 1 is a front view of a low temperature storage cabinet in accordance with the present invention.
Figure 2:
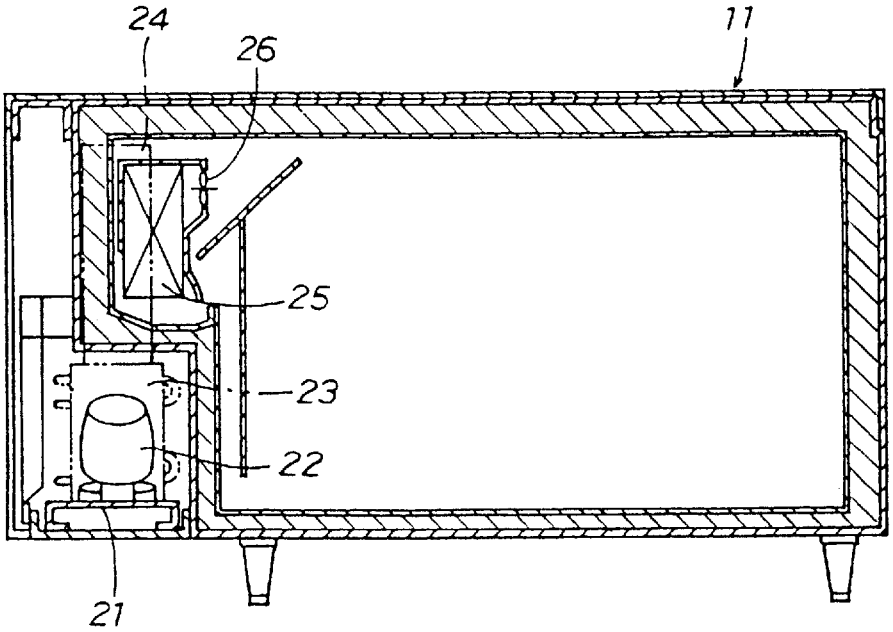
FIG. 2 is a vertical sectional view of the storage cabinet shown in FIG. 1.

Illustrated in FIGS. 1 and 2 is an embodiment of a low temperature storage cabinet in accordance with the present invention. The storage cabinet is composed of a cabinet body 11, a pair of square doors 12 and 13 hinged at their side ends to a rectangular opening frame structure 11*b* of the cabinet body 11 to open and close an opening 11*a* of the cabinet body 11, and a cooling unit 20 mounted within a side portion of the cabinet body 11 and covered with a front panel 14 of the cabinet body 11. In the storage cabinet, a heater 15 for prevention of dewfall is embedded in the opening frame structure 11*b* at the entire peripheral portion thereof.

Figure 3:
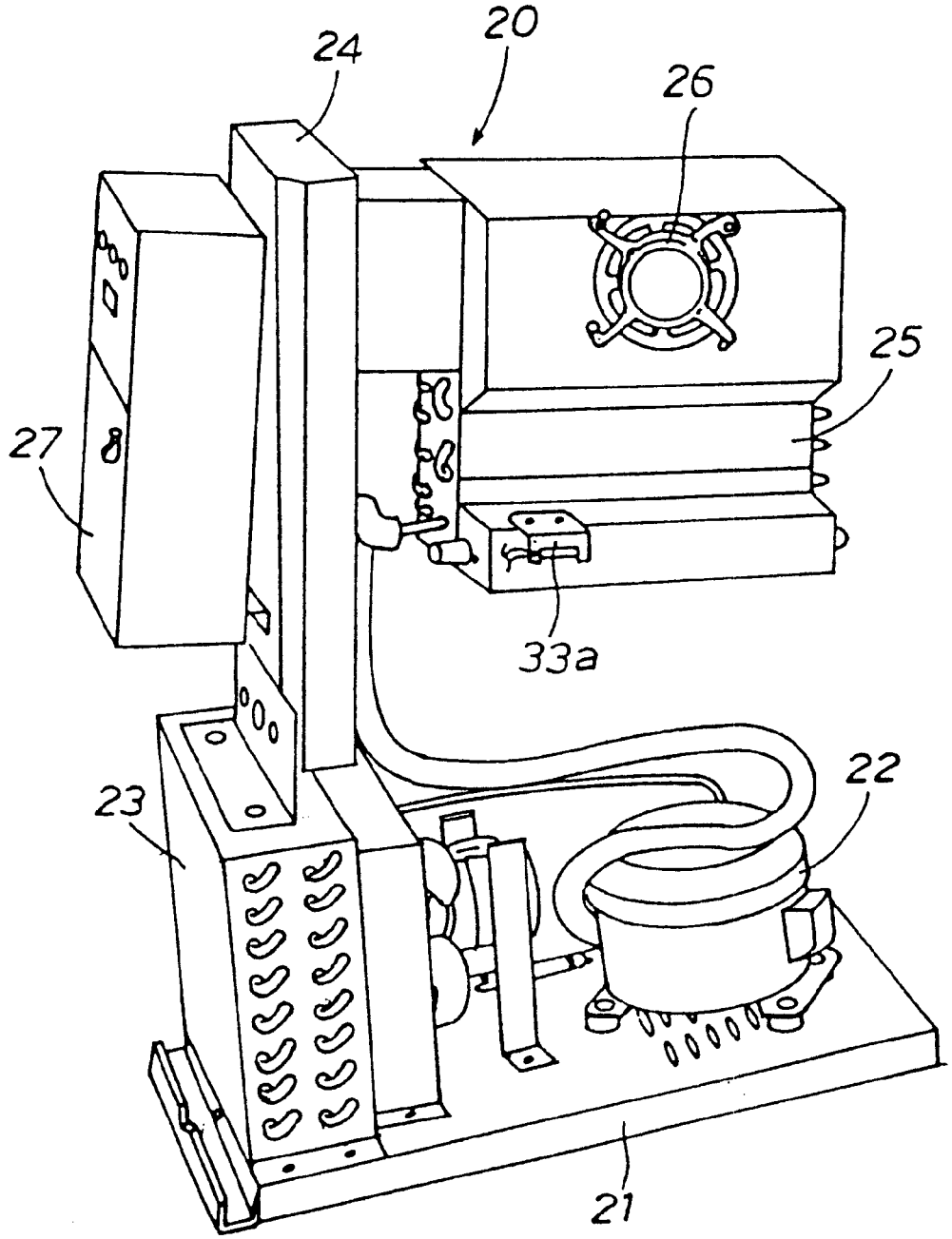
FIG. 3 is a perspective view of a cooling unit assembled within the storage cabinet shown in FIG. 1.
Figure 4:
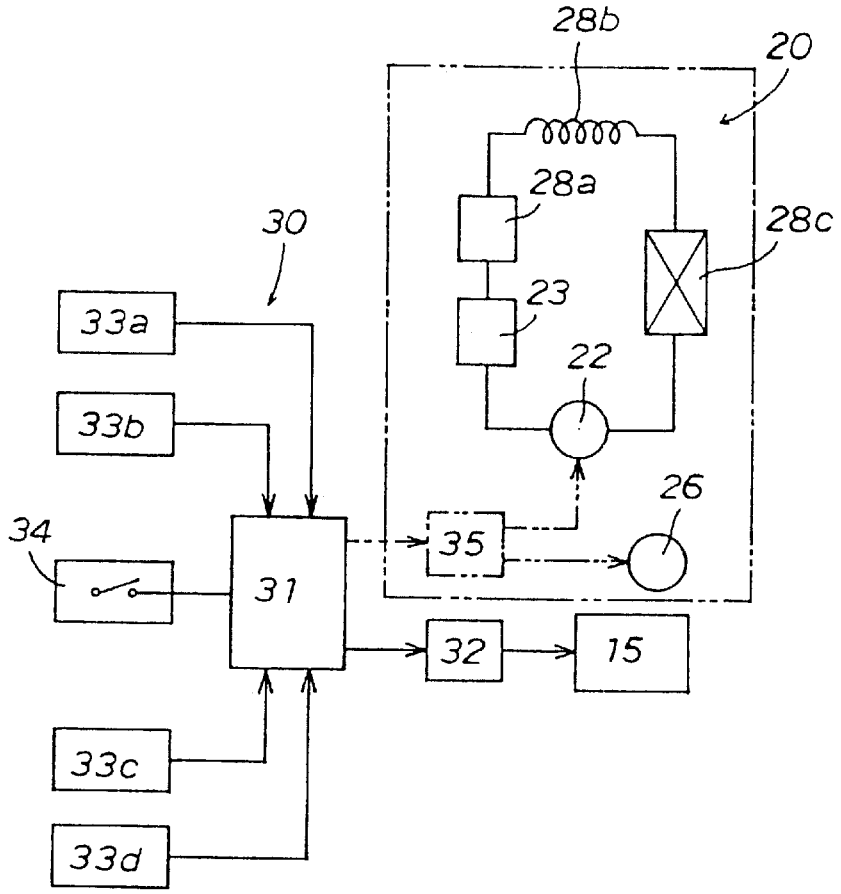
FIG. 4 is a block diagram of an electric control device for the storage cabinet.

As shown in FIGS. 2 and 3, the cooling unit 20 is composed of a compressor 22 and a condenser 23 mounted on a base plate 21, a cooler 25 mounted to a vertical support member 24, a cooling fan 26 installed at a side portion of the cooler 24 and an electric equipment 27. As shown in FIG. 4, the electric equipment 27 includes an electric control device provided with a microcomputer 31 and a driving circuit 32. The microcomputer 31 is connected to an inside temperature sensor 33*a* for detecting an inside temperature of the cabinet, an outside temperature sensor 33*b* for detecting an outside temperature of the cabinet, a humidity sensor 33*c* for detecting outside humidity of the cabinet, a surface temperature sensor 33*d* for detecting a surface temperature of the opening frame structure 11*b*, and an operation switch 34 for switching over operating conditions of the cooling unit 20. The microcomputer 31 is programmed to control activation of the heater 15 through the driving circuit 32 in response to detection signals applied from the sensors 33*a*–33*d* and to control operating conditions of the cooling unit 20 through a driving circuit 35 in response to detection signals from sensors (not shown). In FIG. 4, the reference numerals 98*a*, 28*b* and 28*c* designate a dryer, a throttle portion and an evaporator provided in the cooling unit 20.

In the cooling unit 20, the compressor 32 and cooling fan 26 are operated under control of the computer 31 through the driving circuit 35 to refrigerate the air in the cabinet and to circulate the cooled air for maintaining the inside temperature of the cabinet at a predetermined temperature. During operation of the cooling unit 20, the heater 15 for prevention of dewfall is activated under control of the computer 31 through the driving circuit 32 as described below to prevent the occurrence of dewfall on the surfaces of opening frame structure 11*b* of cabinet body 11.

Figure 5:
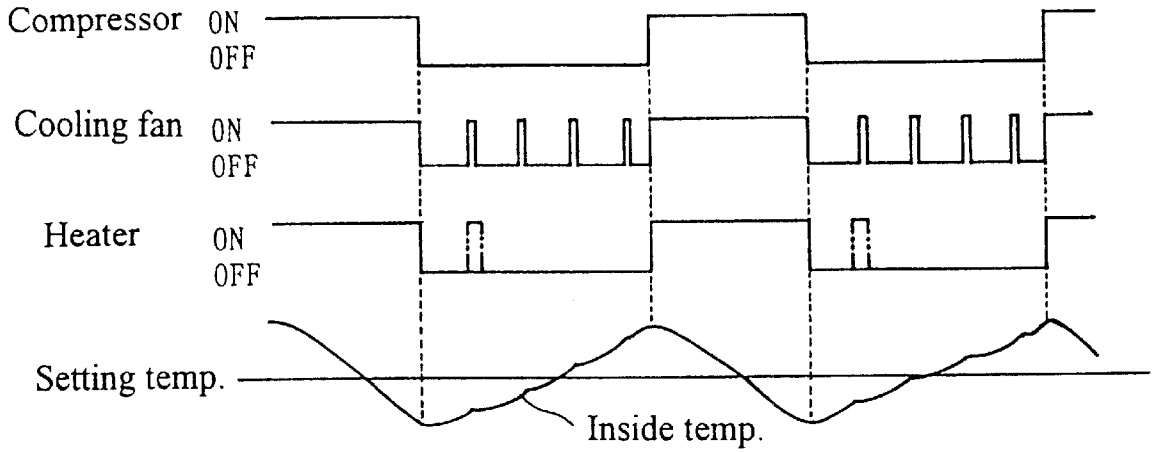
FIG. 5(*a*) is a time chart showing a control condition of activation of a heater for prevention of dewfall in the storage cabinet under control of a first control method according to the present invention.
Figure 5:
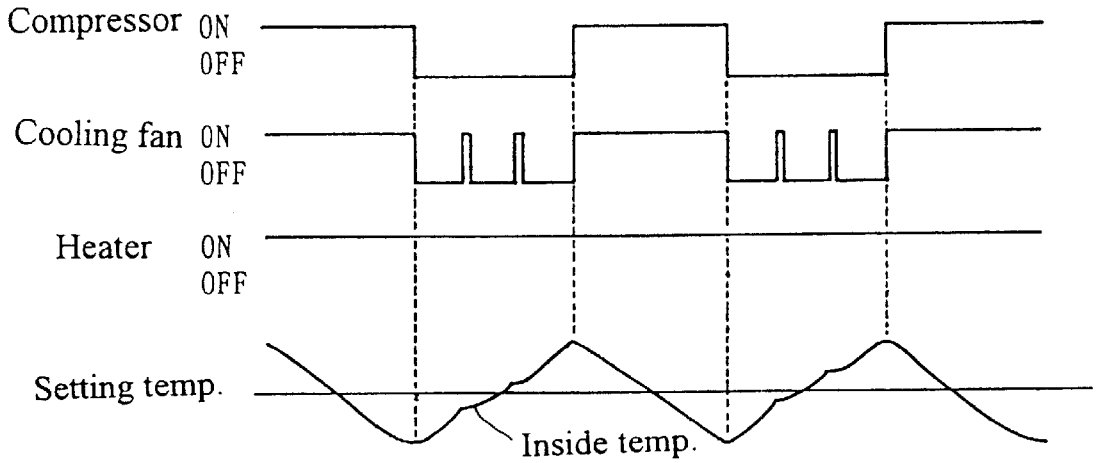

As shown by the time chart of FIG. 5(*a*), the heater 15 for prevention of dewfall is activated synchronously in response to operation of the compressor 22 and is deactivated synchronously in response to stopping of the compressor 22. Under such control of the heater 15, the cooling fan 26 is operated during operation of the compressor 22 to circulate the cooled air in the cabinet and is intermittently operated during stopping of the compressor 22 to maintain the inside temperature of the cabinet at a predetermined temperature. Illustrated in FIG. 5(*b*) is a conventional control method of the heater 15 in contrast with the control method of heater 15 according to the present invention.

Under the conventional control method, the heater 15 is continuously activated irrespectively of operation of the compressor 22 during which a load for cooling the interior of the cabinet increases due to heat generation of the heater 15, resulting in a rise of the inside temperature of the cabinet in a short period of time. This causes frequent operation of the compressor 22, resulting in an increase of electric power consumption. To the contrary, under the control method according to the present invention, the heater 15 is maintained in a deactivated condition during stopping of the compressor 22. This is useful to restrain heat generation of the heater 15 and to decrease consumption of electric power caused by frequent operation.

Figure 6:
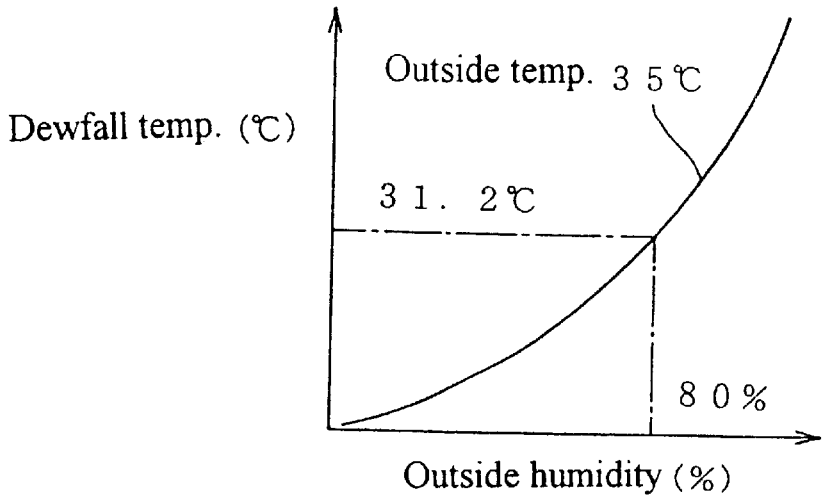
FIG. 6 is a graph showing a temperature of dewfall on an opening frame structure in relation to outside humidity of the storage cabinet in a condition where an outside temperature of the storage cabinet is maintained at a constant value.

Illustrated in FIG. 6 is a dewfall temperature on the surface of the opening frame structure 11*b* in relation to outside humidity of the cabinet at an outside temperature (for instance, 35° C.). In the low temperature storage cabinet, it is preferable that the microcomputer 31 is programmed to calculate the dewfall temperature on the surface of the frame structure in relation to the outside humidity of the cabinet and to control activation of the heater 15 during stopping of the compressor 22 in such a manner that the heater 15 is deactivated when the surface temperature of the opening frame structure 11*b* is higher than the dewfall temperature and that the heater 15 is activated when the surface temperature of the frame structure becomes equal to or lower than the dewfall temperature.

For example, the dewfall temperature on the surface of the opening frame structure becomes 31.2° C. when the outside humidity of the cabinet is 80% at the outside temperature of 35° C. If in such a condition, the surface temperature of the opening frame structure becomes lower than the dewfall temperature, the heater 15 is activated under control of the computer 31 to rise the surface temperature of the frame structure higher than the dewfall temperature as shown by two dots and dash lines in FIG. 5(*a*). Such control of the heater 15 is effective to prevent the occurrence of dewfall on the frame structure when the inside temperature falls after stopping of the compressure 22.

Figure 7A:
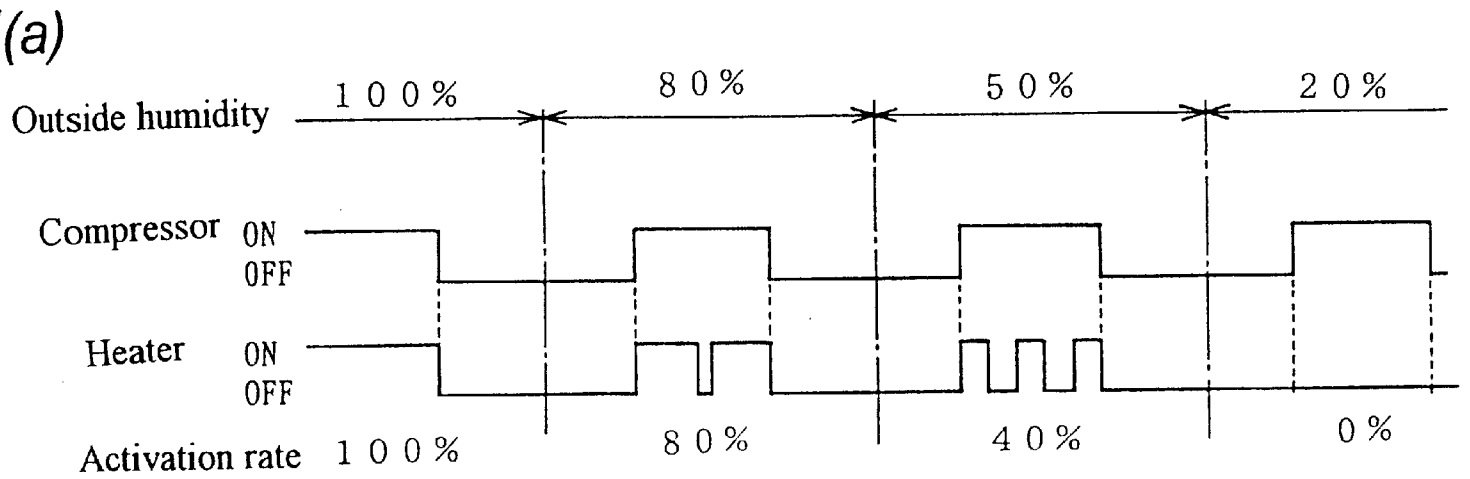
FIGS. 7(*a*) and 7(*b*) each illustrate a time chart showing a control condition of activation of the heater for prevention of dewfall under control of a second control method according to the present invention.
Figure 7B:
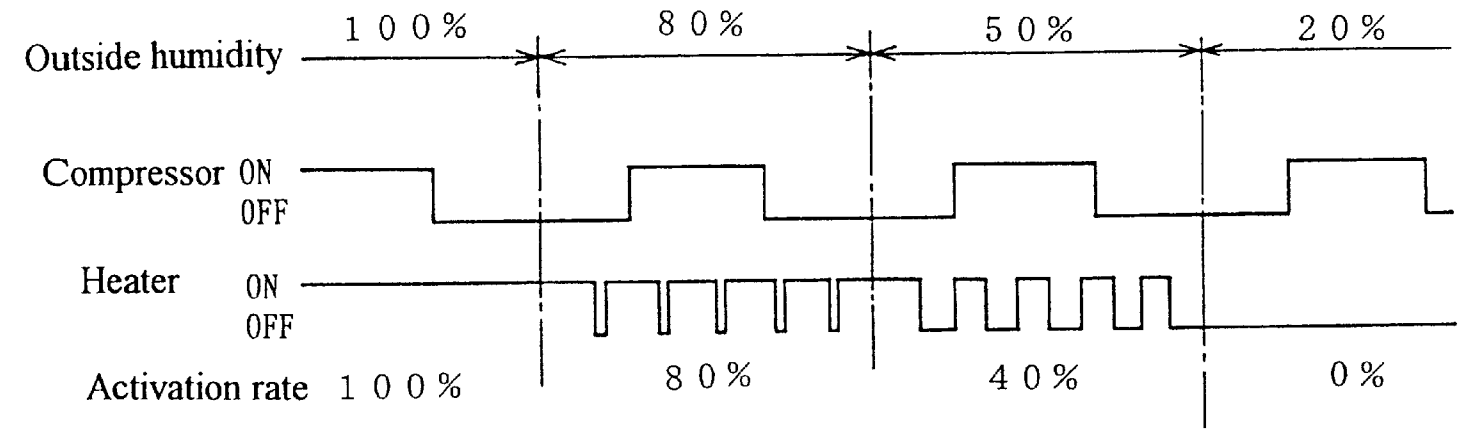

In a practical embodiment of the present invention, the heater 15 for prevention of dewfall on the surface of the frame structure may be activated in accordance with the outside humidity of the cabinet under control of the computer 31 as shown in FIGS. 7(*a*) and 7(*b*). In this control method, the computer 31 is programmed to calculate an activation rate and time of the heater 15 in relation to a decrease of the outside humidity of the cabinet on a basis of the following table 1.

TABLE 1

| Outside humidity (%) | Activation rate (%) | On/off time (sec.) |
|---|---|---|
| 20 | 0 | Off |
| 21–40 | 10 | On: 6, Off: 54 |
| 41–60 | 30 | On: 18, Off: 42 |
| 61–70 | 40 | On: 24, Off: 36 |
| 71–80 | 60 | On: 36, Off: 24 |
| 81–90 | 80 | On: 48, Off: 12 |
| More than 91 | 100 | On |

In a control method shown in FIG. 7(*a*), the heater 15 is activated synchronously in response to operation of the compressor 22 and is deactivated in accordance with the outside humidity of the cabinet during operation of the compressor 22. In a control method shown in FIG. 7(*b*), the heater 15 is activated in accordance with the outside humidity of the cabinet irrespectively of operation of the compressor 22. With the former control method of the heater 15, the activation time of heater 15 can be shortened to restrain a rise of the inside temperature of the cabinet. This is useful to decrease consumption of the electric power required for operation of the compressor 22 and activation of the heater 15.

Figure 8:
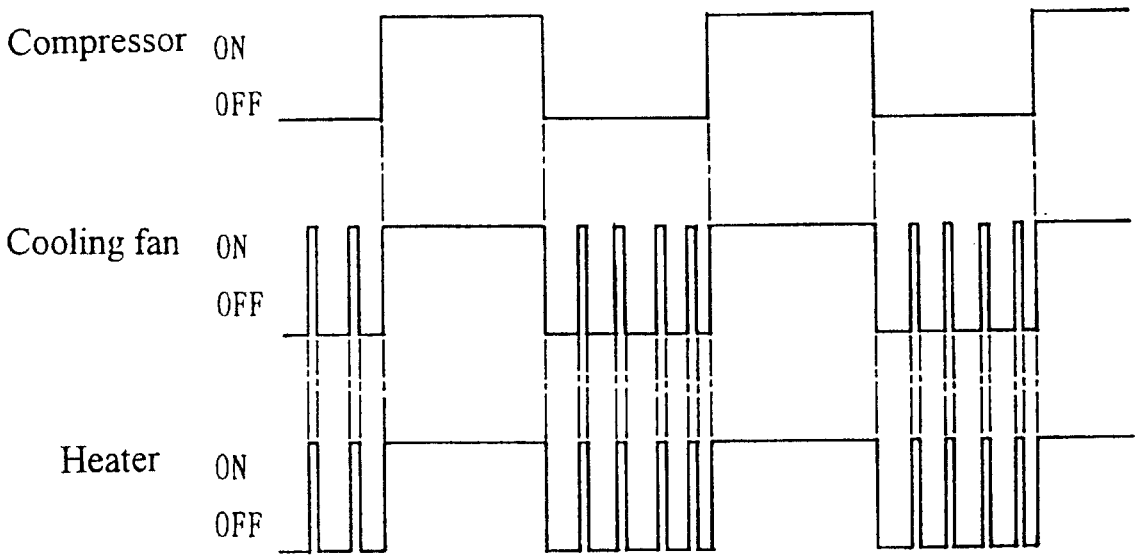
FIG. 8 is a time chart showing a control condition of activation of the heater for prevention of dewfall in the storage cabinet under control of a third control method according to the present invention.

As the cooling fan 26 is operated to uniformly maintain the inside temperature of the cabinet during stopping of the compressor 22, the heater 15 for prevention of dewfall in the cabinet may be activated synchronously in response to operation of the cooling fan 26 as shown in FIG. 8. With this control method of the heater 15, rise of the inside temperature of the cabinet is restrained to decrease consumption of the electric power required for operation of the compressor 22 and for activation of the heater 15. Even if the cool air supplied from the cooler 25 in operation of the cooling fan 26 causes dewfall on the opening frame structure, the dewdrops on the surface of the frame structure will be eliminated by activation of the heater 15 conducted synchronously in response to operation of the cooling fan 26.

In the low temperature storage cabinet, the activation rate of the heater 15 may be controlled in accordance with the inside temperature of the cabinet under control of the computer 31. In such a case, the computer 31 is programmed to calculate an activation rate and time of the heater 15 in relation to the inside temperature of the cabinet on a basis of the following table 2.

TABLE 2

| Internal temp. (° C.) | Activation rate (%) | Activation time (sec.) |
|---|---|---|
| 11–0 | 30 | On: 18, Off: 42 |
| −1—5 | 40 | On: 24, Off: 36 |
| −6—10 | 60 | On: 36, Off: 24 |
| −11—23 | 80 | On: 48, Off: 12 |

Such control of the heater 15 as described above is useful to restrain rise of the inside temperature of the cabinet thereby to decrease consumption of the electric power required for operation of the compressor 22 and activation of the heater 15.

Figure 9:
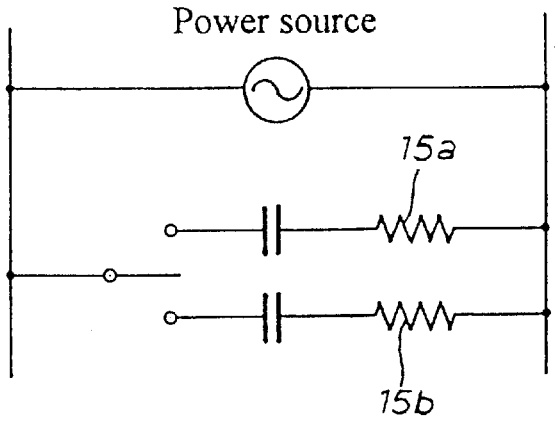
FIG. 9 is a first control circuit for adjusting an activation rate of the heater.

Illustrated in FIG. 9 is a control circuit for controlling the activation rate and time of the heater 15. The control circuit includes two different rating heating elements 15*a* and 15*b* connected in parallel to a power source line. In use of the control circuit, the computer 31 is programmed to calculate an activation rate in relation to outside humidity of the cabinet on a basis of the following table 3. Thus, the heating elements 15*a* and 15*b* are selectively activated under control of the computer 31.

TABLE 3

| Outside humidity (%) | Heating element 15a | Heating element 15b |
|---|---|---|
| 20 | Off | Off |
| 21–50 | On | Off |
| 50–70 | Off | On |
| More than 71 | On | On |

Figure 10A:
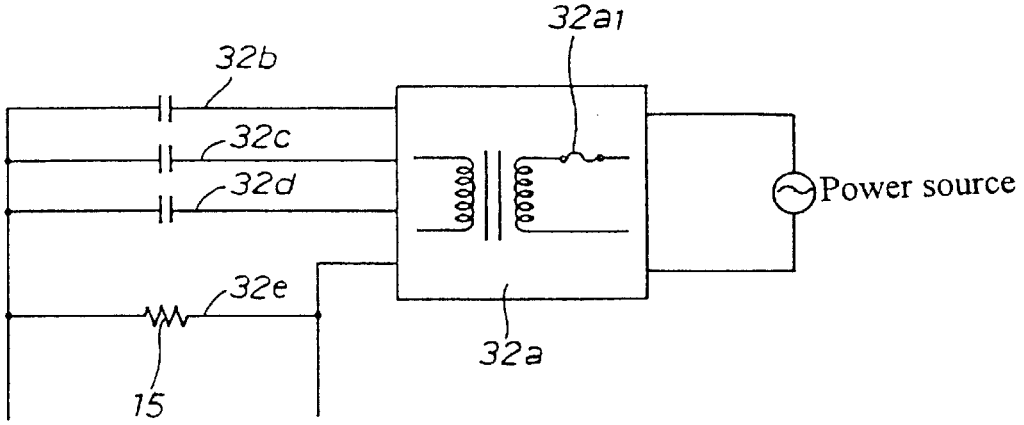
FIG. 10(*a*) is a second control circuit for adjusting an activation rate of the heater.
Figure 10B:
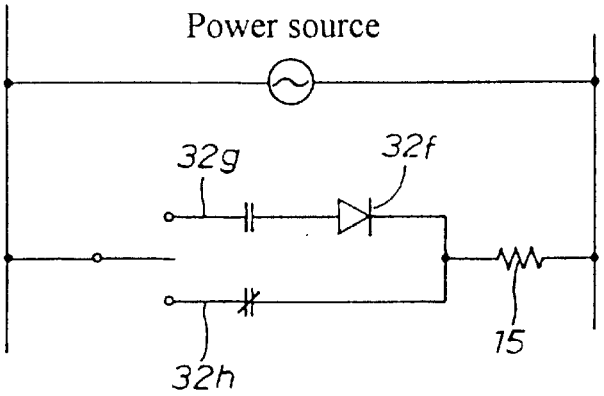

Illustrated in FIG. 10(*a*) is a control circuit substituted for the control circuit of FIG. 9. The control circuit of FIG. 10(*a*) includes a transformer 32*a* connected to an electric power source, first, second and third output circuits 32*b*–32*d* connected in parallel to the transformer 32*a* for applying different voltages and a heating element 15 connected in parallel with the output circuits 32*b*–32*d*. In use of the control circuit, the computer 31 is programed to selectively apply different voltages to the heating element 15 from the output circuits 32*b*–32*d* in accordance with outside humidity of the cabinet in response to a detection signal from the humidity sensor 33*c*. In this control circuit, a fuse 32*a*1 in connection to a primary winding of the transformer 32*a* serves to interrupt supply of the electric power in the occurrence of short of the heating element 15.

Illustrated in FIG. 10(*b*) is another control circuit substituted for the control circuit of FIG. 9. The control circuit of FIG. 10(*b*) includes a heating element 15 connected in parallel to an electric power source through first and second output circuits 32*g* and 32*h* and a diode 32*f* disposed in the first output circuit32*g*. In use of the control circuit, the computer 31 is programmed to selectively apply different voltages to the heating element 15 in accordance with outside humidity of the cabinet in response to a detection signal from the humidity sensor 33.

What is claimed is:

1. A low temperature storage cabinet including a heater embedded in an opening frame structure of the cabinet to prevent the occurrence of dewfall on a surface of the frame structure to be brought into contact with a door hinged to the cabinet body, and a compressor the operation of which is controlled in accordance with an inside temperature of the cabinet to maintain the inside temperature of the cabinet at a predetermined value, wherein the heater is activated synchronously in response to operation of the compressor and is deactivated in accordance with a decrease of outside humidity of the s cabinet during operation of the compressor, and wherein the heater is deactivated synchronously in response to stopping of the compressor and maintained in a deactivated condition during stopping of the compressor.

2. A low temperature storage cabinet as claimed in claim 1, wherein the storage cabinet includes an outside temperature sensor for detecting an outside temperature of the cabinet, a humidity sensor for detecting outside humidity of the cabinet, a surface temperature sensor for detecting a surface temperature of the opening frame structure, and control means for calculating a dewfall temperature on the surface of the opening frame structure based on the outside temperature and outside humidity detected by the outside temperature sensor and humidity sensor and for controlling activation of the heater in response to a detection signal from the surface temperature sensor during stopping of the compressor in such a manner that the heater is deactivated when the surface temperature of the frame structure is higher than the dewfall temperature and that the heater is activated when the surface temperature of the frame structure becomes equal to or lower than the dewfall temperature.

3. A low-temperature storage cabinet including a heater embedded in an opening frame structure of the cabinet to prevent the occurrence of dewfall on a surface of the frame structure to be brought into contact with a door hinged to the cabinet body, a compressor the operation of which is controlled in accordance with an inside temperature of the cabinet to maintain the inside temperature of the cabinet at a predetermined value, and a cooling fan the operation of which is controlled in response to operation of the compressor, wherein the storage cabinet includes an inside temperature sensor for detecting an inside temperature of the cabinet and control means for activating the heater synchronously in response to operation of the compressor and for deactivating the heater synchronously in response to stopping of the compressor and maintaining the heater in a deactivated condition during stopping of the compressor, and wherein said control means comprises means responsive to a detection signal from the inside temperature sensor for calculating an activation rate and time of the heater in relation to the inside temperature of the cabinet and for controlling activation of the heater at the calculated activation rate and time synchronously in response to operation of the cooling fan during stopping of the compressor.

4. A low-temperature storage cabinet including a heater embedded in an opening frame structure of the cabinet to prevent the occurrence of dewfall on a surface of the frame structure to be brought into contact with a door hinged to the cabinet body, and a compressor the operation of which is controlled in accordance with an inside temperature of the cabinet to maintain the inside temperature of the cabinet at a predetermined value, wherein the storage cabinet includes a humidity sensor for detecting outside humidity of the cabinet and control means for activating the heater synchronously in response to operation of the compressor and for deactivating the heater synchronously in response to stopping of the compressor and maintaining the heater in a deactivated condition during stopping of the compressor, and wherein said control means comprises means responsive to a detection signal from the humidity sensor for calculating an activation rate and time of the heater in relation to the outside humidity of the cabinet and for controlling activation of the heater at the calculated activation rate and time during operation of the compressor.

5. A low temperature storage cabinet as claimed in claim 4, wherein said heater includes a set of different rating heating elements connected in parallel to a power source line to be selectively activated under control of said control means at the calculated activation rate and time during operation of the compressor.

6. A low temperature storage cabinet as claimed in claim 4, wherein said heater comprises a heating element connected in parallel with a plurality of output circuits to be selectively applied with different voltages from the output circuits under control of said control means.

* * * * *